US006087779A

United States Patent [19]

Sakamoto et al.

[11] Patent Number: 6,087,779

[45] Date of Patent: Jul. 11, 2000

[54] METHOD OF DRIVING PLASMA DISPLAY AND PLASMA DISPLAY APPARATUS USING THE METHOD

[75] Inventors: Tetsuya Sakamoto; Tomokatsu Kishi; Shigetoshi Tomio; Keishin Nagaoka; Takahiro Takamori; Jun Machida; Akihiro Takagi, all of Kawasaki, Japan

[73] Assignee: Fujitsu Limited, Kawasaki, Japan

[21] Appl. No.: 09/248,107

[22] Filed: Feb. 11, 1999

[30] Foreign Application Priority Data

Sep. 10, 1998 [JP] Japan ..... 10-256825

[51] Int. Cl.[7] ..... G09G 3/10

[52] U.S. Cl. ..... 315/169.1; 315/169.4; 345/204

[58] Field of Search ..... 315/169.1, 169.4, 315/169.2, 169.3; 345/55, 60, 37, 63

[56] References Cited

U.S. PATENT DOCUMENTS 5,446,344 8/1995 Kanazawa ..... 315/169.4
5,835,072 11/1998 Kanazawa ..... 345/60
5,854,540 12/1998 Matsumoto et al. ..... 315/169.1
5,874,932 2/1999 Nagaoka et al. ..... 345/60
5,959,619 9/1999 Kameyama et al. ..... 345/204
6,002,381 12/1998 Tomio et al. ..... 345/60

*Primary Examiner*—Don Wong
*Assistant Examiner*—Tuyet T. Vo
*Attorney, Agent, or Firm*—Staas & Halsey LLP

[57] ABSTRACT

A method of driving a plasma display is disclosed, in which the deterioration of the display quality which otherwise might be caused by the light emission due to a reset pulse is prevented thereby to improve the display quality. The voltage of the reset pulse is set taking the voltage due to the accumulated charge into consideration in accordance with a specific display. In this way, the self-erasure discharge is not caused in all the cells but only in the cells involved in display. The display brightness is set also for the self-erasure discharge as a discharge involved in display like the sustaining discharge.

21 Claims, 13 Drawing Sheets

METHOD OF DRIVING PLASMA DISPLAY AND PLASMA DISPLAY APPARATUS USING THE METHOD

BACKGROUND OF THE INVENTION

The present invention relates to a method of driving a plasma display panel (PDP) of three-electrode AC type or, in particular, to a technique for resetting each cell of the PDP to a predetermined state.

The AC-type PDP continues to discharge and emit light for display in accordance with a voltage waveform applied alternately to two sustaining electrodes thereof. Each session of discharge is completed within 1 μs to several μs from the pulse application. The ions that are the positive charge generated by the discharge are accumulated on the surface of an insulating layer on an electrode supplied with a negative voltage. In a similar fashion, the electrons which are negative charge are accumulated on the surface of an insulating layer on an electrode supplied with a positive voltage.

If a wall charge is initially generated by a discharge with a pulse (write pulse) of a high voltage, followed by application of a pulse (a sustaining pulse or a sustaining discharge pulse) of a voltage (sustaining voltage or a sustaining discharge voltage) lower than and having a different polarity from the preceding voltage, then the pulse is superposed on the wall charge previously accumulated, and increases the voltage of the discharge space to such an extent that the discharge starts over a threshold value of the discharge voltage. Specifically, a cell, once gaining a wall charge by a write discharge, sustains the discharge when supplied with alternate sustaining pulses of opposite polarities. This is called the memory effect or the memory function. Generally, the AC-type PDP uses this memory effect for display.

The AC-type PDP is of two types, one a two-electrode type in which selective discharge (addressing discharge) and sustaining discharge are carried out with two electrodes, and the other a three-electrode type in which a third electrode is used for addressing discharge. In the color PDP for effecting gradation display, the phosphor material formed in the discharge cell is excited by the ultraviolet light generated by the discharge. The disadvantage of this phosphor material is that it easily succumbs to the impact of ions making up the positive charge generated at the same time as the discharge. The PDP of a two-electrode type is so configured that the phosphor material comes into direct contact with ions, which is liable to shorten the life of the phosphor material. In order to avoid this inconvenience, the color PDP generally uses the three-electrode structure utilizing the surface discharge. The PDP of three-electrode type is further classified into a configuration in which the third electrode is formed on the same substrate that the first and second electrodes for sustaining discharge are arranged on and a configuration in which the third electrode is arranged on the other substrate in opposed relation to the first substrate. The configuration in which three electrodes are formed on the same substrate is also subdivided into a configuration in which a third electrode is arranged on the two electrodes for sustaining discharge and a configuration in which a third electrode is arranged under the other two electrodes. Further, the visible light emitted from the phosphor material is either transmitted through the phosphor material (transmission type) or reflected from the phosphor material (reflection type). The present invention is applied to the three-electrode AC-type PDP. An explanation will be given with reference to the reflection type of PDP comprising a panel including a third electrode formed on a substrate in opposed relation to the substrate of the sustaining discharge electrodes, in which a part of the sustaining electrode is formed of a transparent electrode.

In the conventional method of driving a three-electrode AC-type PDP based on the "write addressing method of addressing/sustaining discharge period separation type", each subfield is configured of a reset period, an addressing period and a sustaining discharge period, and a self-erasure discharge is caused by applying a reset pulse of high voltage so that all the cells discharge during the reset period. The light emission by the application of the reset pulse and the light emission by self-erasure discharge also contribute to the display. The light emission at all the cells regardless of the specific contents of the display increases the background brightness for a reduced contrast. Also, for gradation display in the PDP apparatus, each frame is segmented into a plurality of subfields, and the frequency of the sustaining discharge in each subfield is changed in accordance with the weight of the brightness. With a subfield of small weight, for example, the sustaining discharge is effected only several times. The light emission at all the cells, therefore, deteriorates the linearity of gradation display. In recent years, the display quality of the PDP apparatus has been improved to such an extent that the deterioration of display quality due to the fact described above has begun to pose a problem.

SUMMARY OF THE INVENTION

The object of the present invention is to realize a method of driving a plasma display and a plasma display apparatus employing such a driving method, in which the deterioration of display quality by the light emission by the reset pulse as described above is prevented to improve the display quality.

In order to achieve the object described above, according to the present invention, there is provided a method of driving a plasma display panel, in which the voltage of the reset pulse is set taking into consideration the voltage due to the charge accumulated in accordance with the display, so that the self-erasure discharge is caused not in all the cells but only in the cells involved in display. For the self-erasure discharge, like the sustaining discharge, the display brightness is set as a discharge involved in display.

Specifically, according to this invention, there is provided a method of driving a plasma display panel comprising a plurality of pairs of first and second electrodes arranged in parallel, and a plurality of third electrodes crossed with the pairs of the first and second electrodes, wherein a plurality of cells adapted to discharge and emit light are determined selectively by the first, second and third electrodes, comprising the steps of causing the self-erasure discharge by applying a reset voltage to at least a part of the first, second and third electrodes and thereby causing a plurality of cells to discharge, and neutralizing the charge of the electrodes thereby to set a plurality of cells in a predetermined state (reset step), applying a voltage in accordance with the display data to each cell in the predetermined state and accumulating the charged corresponding to the display data for each cell (addressing step), and applying a sustaining discharge voltage to a plurality of cells and causing the cells having a predetermined charge accumulated therein to discharge and emit light (sustaining discharge step), the reset voltage being set in such a manner as to cause the self-erasure discharge when the reset voltage is superposed on the charge accumulated in the electrodes of a plurality of cells, the self-erasure discharge being effected selectively by a part of a plurality of cells.

In the case where the reset voltage is set in such a manner that the self-erasure discharge occurs when the reset voltage is superposed on the voltage due to the charge accumulated in the electrodes of the cells that have discharged in the sustaining discharge step, the self-erasure discharge in the reset step occurs only in the cells that have discharged in the sustaining discharge step. The cells that have not discharged in the sustaining discharge step, in which the wall charge is not accumulated, require no self-erasure discharge. The discharge by the reset pulse and the resulting self-erasure discharge are carried out only in the cells to be displayed. Therefore, the resulting light emission does not increase the background brightness and therefore the contrast is not reduced. Also, in the case the display brightness is set also for the charge by the reset pulse and the resulting self-erasure discharge as a discharge involved in display like the sustaining discharge, the linearity of the gradation display is maintained.

In the first reset step after activation of the plasma display, the sustaining discharge step has not been carried out and the wall charge is not accumulated, and therefore, the reset voltage is set in such a manner that the self-erasure discharge occurs in all of a plurality of cells without wall charge. In the second and subsequent reset steps, on the other hand, the reset voltage is reduced as compared with the voltage for the first reset step, so that the self-erasure discharge occurs only in the cells that have discharged in the sustaining discharge step.

The reset voltage for the second and subsequent reset steps is increased beyond the sustaining discharge voltage, so that the amount of wall charge accumulated by the reset pulse is made larger than the amount of wall charge accumulated by the sustaining discharge to assure that the self-erasure discharge occurs when the Y and X electrodes are set to the same potential. In other words, the voltage of the last sustaining discharge pulse is increased to cause the self-erasure discharge.

Also, the time of application of the reset voltage for the second and subsequent reset steps is shortened as compared with the application time of the other sustaining discharge voltages thereby to neutralize the charge without accumulation of the wall charge.

Further, in order to assure the occurrence of the self-erasure discharge after complete application of a reset pulse, a voltage sufficiently smaller than another reset voltage opposite in polarity to the first reset pulse can be applied after complete application of the first reset pulse. After complete application of a reset pulse, the self-erasure discharge occurs due to the wall charge accumulated by the reset pulse. By applying a voltage of opposite polarity, however, the self-erasure discharge is more positively caused. In the process, the wall charge is not accumulated if the voltage of opposite polarity is sufficiently lower than the reset voltage.

The self-erasure discharge is not caused simply by the wall charge accumulated by the sustaining discharge. Even in the case where a pulse of a low voltage, opposite in polarity to the immediately-preceding sustaining discharge voltage, is applied as a reset pulse, however, the discharge occurs once the sum of the low reset pulse voltage and the voltage due to the wall charge reaches a level not lower than the discharge starting voltage. At this time, the wall charge is not accumulated if the reset pulse voltage is low.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before proceeding to a detailed description of the preferred embodiments, a fundamental constitution of a plasma display apparatus and a conventional drive method of the plasma display apparatus will be described with reference to the accompanying drawings for a clearer understanding of the difference between the conventional art and the present invention.

Figure 1:
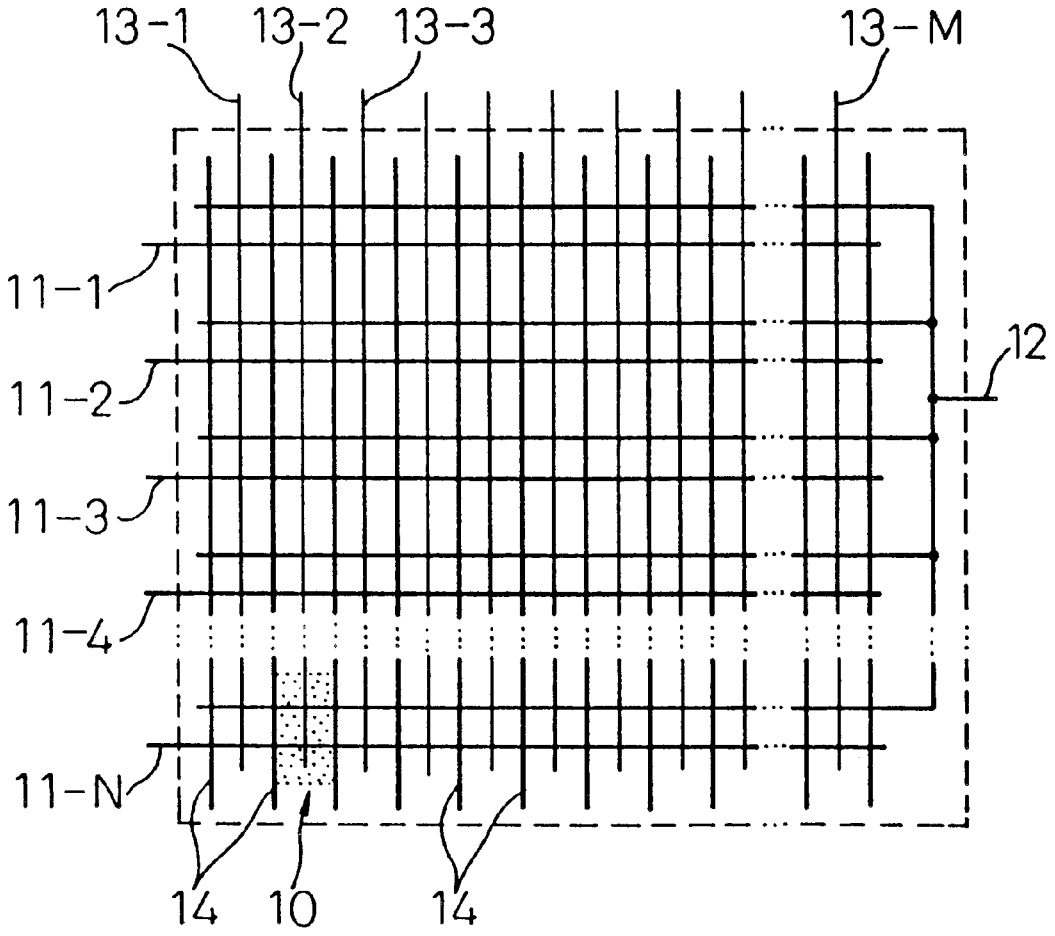
Fig. 1 (PRIOR ART)
FIG. 1 is a plan view schematically showing a three-electrode surface-discharge AC-type PDP.
Figure 2:
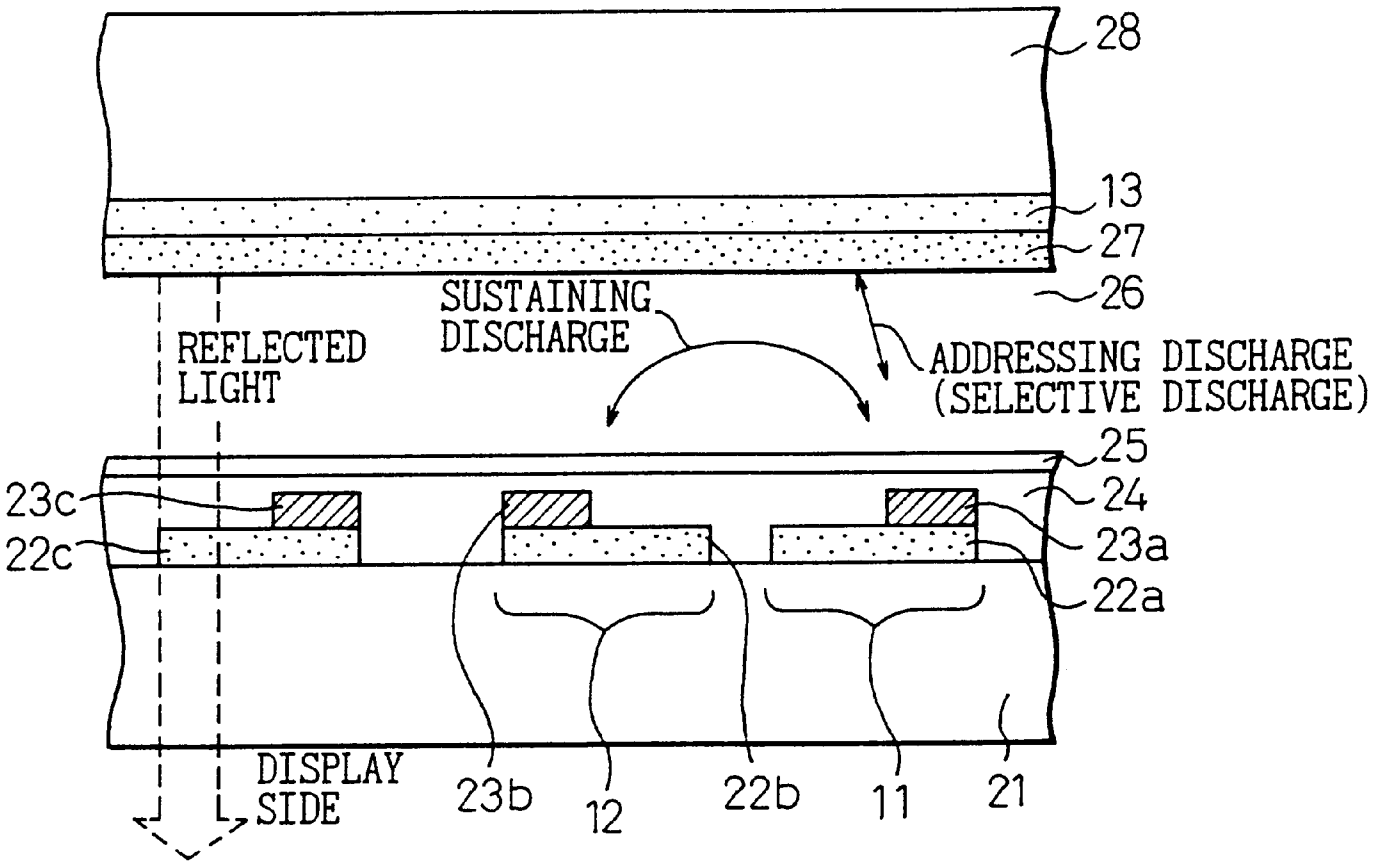
Fig. 2 (PRIOR ART)
FIG. 2 is a sectional view schematically showing a three-electrode surface-discharge AC-type PDP.
Figure 3:
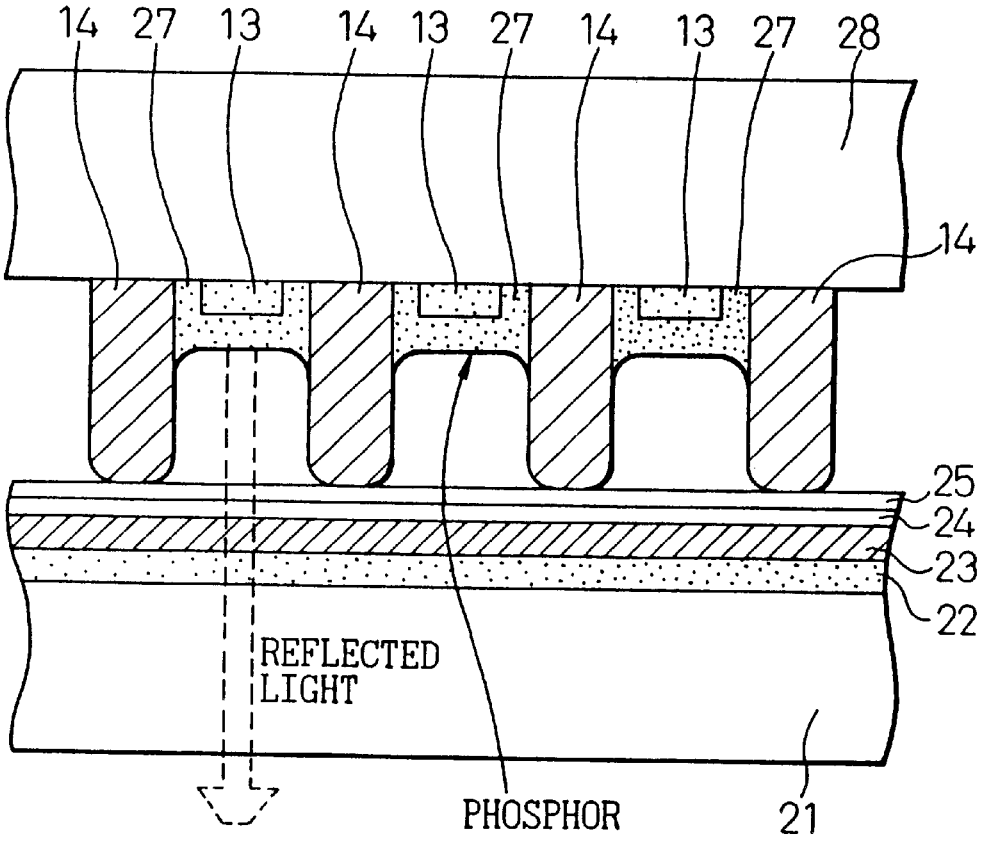
Fig. 3 (PRIOR ART)
FIG. 3 is a sectional view schematically showing a three-electrode surface-discharge AC-type PDP.

FIG. 1 is a plan view schematically showing a three-electrode AC-type PDP, FIG. 2 is a (vertical) sectional view schematically showing a discharge cell of the panel shown in FIG. 1, and FIG. 3 is a (horizontal) sectional view schematically showing the cell. In the diagrams described below, each component part having the same function will be designated by the same reference numeral.

A panel is configured of two glass substrates 21, 28. The first substrate 21 includes first electrodes (X electrodes) 12 and second electrodes (Y electrodes) 13 constituting parallel sustaining electrodes. These electrodes are made up of transparent electrodes 22*a*, 22*b* and bus electrodes 23*a*, 23*b*. The transparent electrodes are required to transmit the light reflected from a phosphor material and therefore are formed of ITO (a transparent conductive film mainly composed of indium oxide) or the like. The bus electrodes, which are required to be formed with a low resistance to prevent a voltage drop, are made of Cr (chromium) or Cu (copper). Further, these component parts are covered with a dielectric (glass) layer 24, and a MgO (magnesium oxide) film 25 is formed as a protective film on the discharge surface. The second substrate 29 in opposed relation to the first glass substrate 21, on the other hand, is formed with third electrodes (addressing electrode) 13 at right angles to the sustaining electrodes. Barriers 14 are formed each between each adjacent pair of addressing electrodes, and phosphor members 27 having a luminous characteristics of red, green and blue covering the addressing electrodes are formed between the barriers. The two glass substrates are assembled with the ridges of the barriers 14 and the surface of the MgO film closely contacting each other. The space between the phosphor members 27 and the MgO film surface 25 constitutes a discharge space 26.

Figure 4:
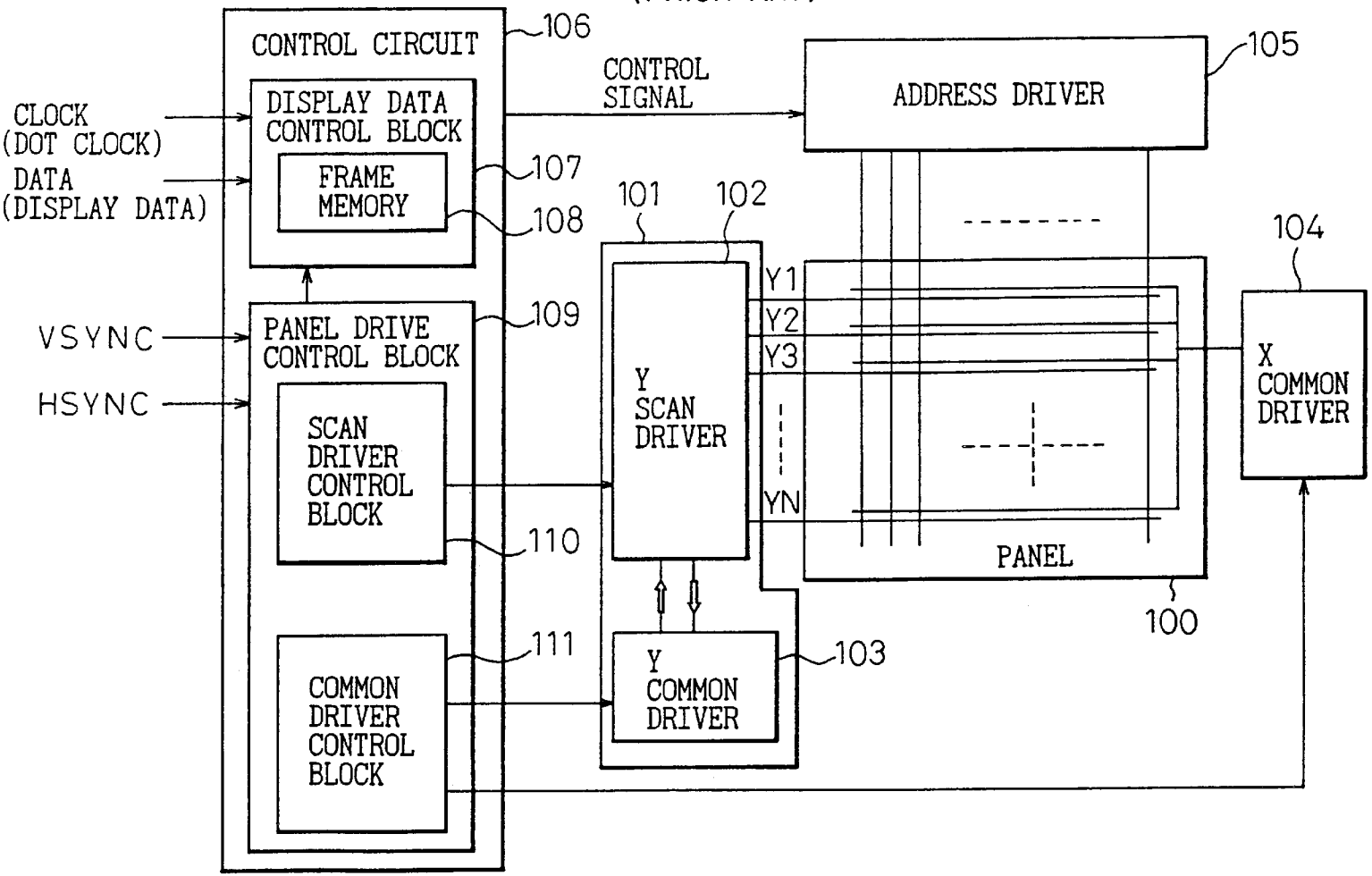
Fig. 4 (PRIOR ART)
FIG. 4 is a block diagram of a drive circuit for the three-electrode surface-discharge AC-type PDP.

FIG. 4 is a block diagram schematically showing peripheral circuits for driving the PDP of FIGS. 1 to 3. Addressing electrodes 13-1, 13-2, . . . are each connected to an address driver 105, whereby an addressing pulse is applied at the time of addressing discharge. Also, Y electrodes 11-1, 11-2, . . . are connected to a Y driver 101. The Y driver 101 includes a Y scan driver 102 and a Y common driver 103, and the Y electrodes are connected individually to the Y scan driver 102. The Y scan driver 102 is connected to the Y common driver 103. The pulses for addressing discharge are generated by the Y scan driver 102, while the sustaining pulses and the like are generated by the Y common driver 103 and, through the Y scan driver 102, applied to the Y electrodes. The X electrodes 12 are connected to all the display lines of the panel and led out as a common electrode. The X common driver 104 generates a write pulse, a sustaining pulse and the like. These driver circuits are controlled by a control circuit, which is, in turn, controlled by a sync signal and a display data signal input thereto from a source external to the apparatus.

The gradation of the PDP is displayed by setting each bit of the display data to a corresponding subfield period and changing the length of the subfield period in accordance with the weight of the bit. In displaying 256 gradation levels, for example, the display data are given by 8 bits, one frame is displayed in eight subfield periods and each bit data is displayed in each of the subfield periods. The subfield period has a length of 1, 2, 4, 8, 16, 32, 64 or 128.

Figure 5:
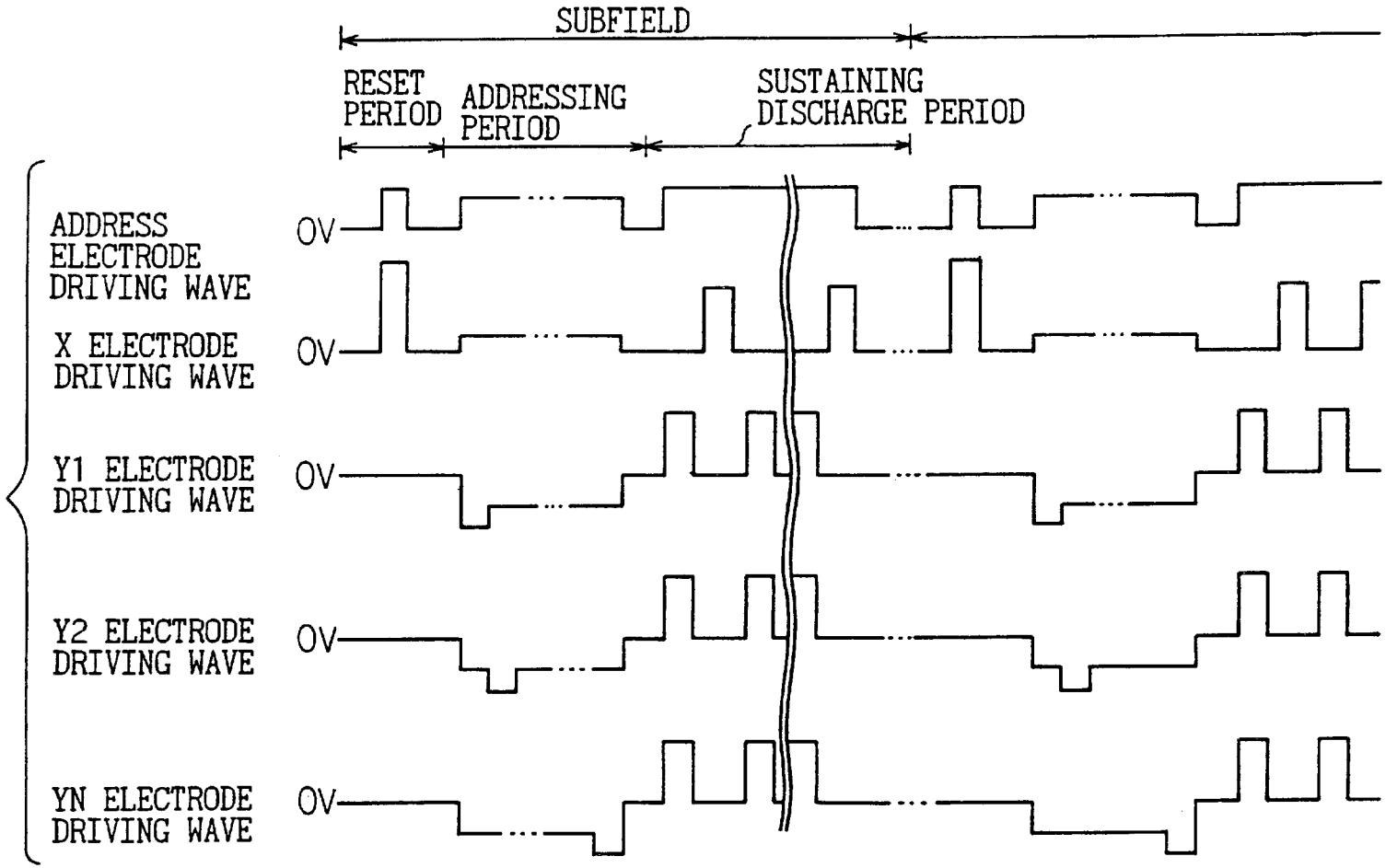
Fig.5 (PRIOR ART)
FIG. 5 is a diagram showing drive waveforms according to the prior art.

FIG. 5 is a waveform diagram showing the conventional method of driving the PDP of FIGS. 1 to 3 by the circuit of FIG. 4. These drive waveforms of the prior art represent what is called "the write addressing method of addressing/sustaining charge period separation type". In this example, one subfield is segmented into a reset period, an addressing period and a sustaining discharge period. First, during the reset period, all the Y electrodes are reset to 0 V level. At the same time, the full surface write pulse of a high voltage (about 330 V) is applied from the X electrodes, and all the cells on all the display lines are discharged regardless of the past display mode. At this time, the potential of the addressing electrodes is about 100 V. Then, the potentials of the X electrodes and the addressing electrodes are reduced to 0 V, so that the voltage of the wall charge itself of all the cells exceeds the discharge starting voltage. Thus the discharge starts. This discharge is what is called the self-erasure discharge, in which the charge disappears due to self neutralization. As a result of the self-erasure discharge, all the cells in the panel assume a uniform state free of wall charges. The reset period has the function of setting all the cells into the same state regardless of whether the preceding subfield is turned on or not, thereby stabilizing the next addressing (write) discharge.

Next, the addressing discharge is effected line by line during the addressing period in order to turn on/off the cells in accordance with the display data. First, a predetermined voltage (about 50 V) is applied to the X electrodes, while a scan pulse (about −150 V) is applied sequentially to the Y electrodes. At the same time, Addressing pulses (about 50 V) are applied selectively to the addressing electrodes corresponding to the cells adapted to develop a sustaining discharge i.e. the addressing electrodes associated with the cells to be turned on. Thus, a discharge occurs between the Y electrodes and the addressing electrodes of the cells to be turned on. With this discharge as priming, the discharge occurs between the X electrodes and the Y electrodes, so that the wall charge of an amount permitting the sustaining discharge is accumulated on the MgO film surface of the two electrodes. A predetermined voltage (about −50 V) for preventing discharge is applied to the Y electrodes not supplied with the scan pulse.

A similar operation is also performed sequentially for other display lines, and thus new display data are written over all the display lines.

After that, when the sustaining discharge period arrives, the X and Y electrodes are supplied with a sustaining pulse (about 180 V) alternately and conduct the sustaining discharge to display an image for one subfield. As described above, the wall charge is accumulated between the X and Y electrodes of the display cells during the addressing period, and the voltage due to this wall charge is superposed on the sustaining pulse to cause the discharge. No wall charge is accumulated on the cells not displayed. These cells develop no discharge even when supplied with a sustaining pulse. Also, an addressing voltage of about 100 V is applied to the addressing electrode in order to avoid the discharge between the addressing electrode and the X or Y electrodes. In this "write addressing method of addressing/sustaining discharge separation type", the brightness is determined by the length of the sustaining discharge period, i.e. the frequency of the sustaining pulses.

Now, the relation between the applied voltage and the wall charge will be explained with reference to FIG. 6. Assume that the Y electrodes are set to 0 and the X electrodes are supplied with a voltage VX1 when no charge is accumulated on the X or Y electrodes. The discharge occurs as long as the absolute value of VX1 is not lower than the discharge-start threshold voltage (discharge starting voltage) VF. No discharge occurs when the absolute value of VX1 is lower than VF. As soon as the discharge begins to occur, positive and negative charges are generated. The positive charge is accumulated on the Y electrodes, and the negative charge is accumulated on the X electrodes. The positive charge accumulated on the Y electrodes increases the potential of the Y electrodes by ΔVY, while the charge accumulated on the X electrodes decreases the potential of the X electrodes by ΔVX. As a result, the potential of the X electrodes becomes VX1−ΔVX, and the potential of the Y electrodes becomes ΔVY. The voltage between X and Y electrodes thus assumes VX1−ΔVX−ΔVY. When the absolute value of this figure is reduced to or below VF, the discharge stops. In this way, the amount of the charge accumulated on the X and Y electrodes changes with the applied voltage VX1. When 0 V is applied to the X electrodes, on the other hand, the potential of the X electrodes becomes −ΔVX, and the potential of the Y electrodes becomes ΔVY. Thus, the voltage between the X and Y electrodes is −ΔVX−ΔVY. The discharge occurs as long as the absolute value of this voltage is not lower than VF, but no discharge occurs otherwise.

As shown in FIG. 5, the voltage of the pulse for the full surface write which is applied to the X electrodes during the reset period is so high that a large amount of wall charge is accumulated on the X and Y electrodes at the time point when the discharge stops. The corresponding absolute values of ΔVX and ΔVY are also large. When the X and Y electrodes are reduced to 0 V, the self-erasure discharge occurs and the wall charge is neutralized. On the other hand, only a small sustaining charge voltage is applied to the X and Y electrodes during the sustaining discharge period. The voltage obtained by superposing the charge accumulated by selective discharge during the addressing period is set to a value slightly higher than the discharge starting voltage. Therefore, at the time point when the discharge by each sustaining discharge pulse stops, only a small amount of wall charge is accumulated on the X and Y electrodes. No discharge occurs, therefore, even when the X and Y electrodes are set to 0 V.

Figure 6:
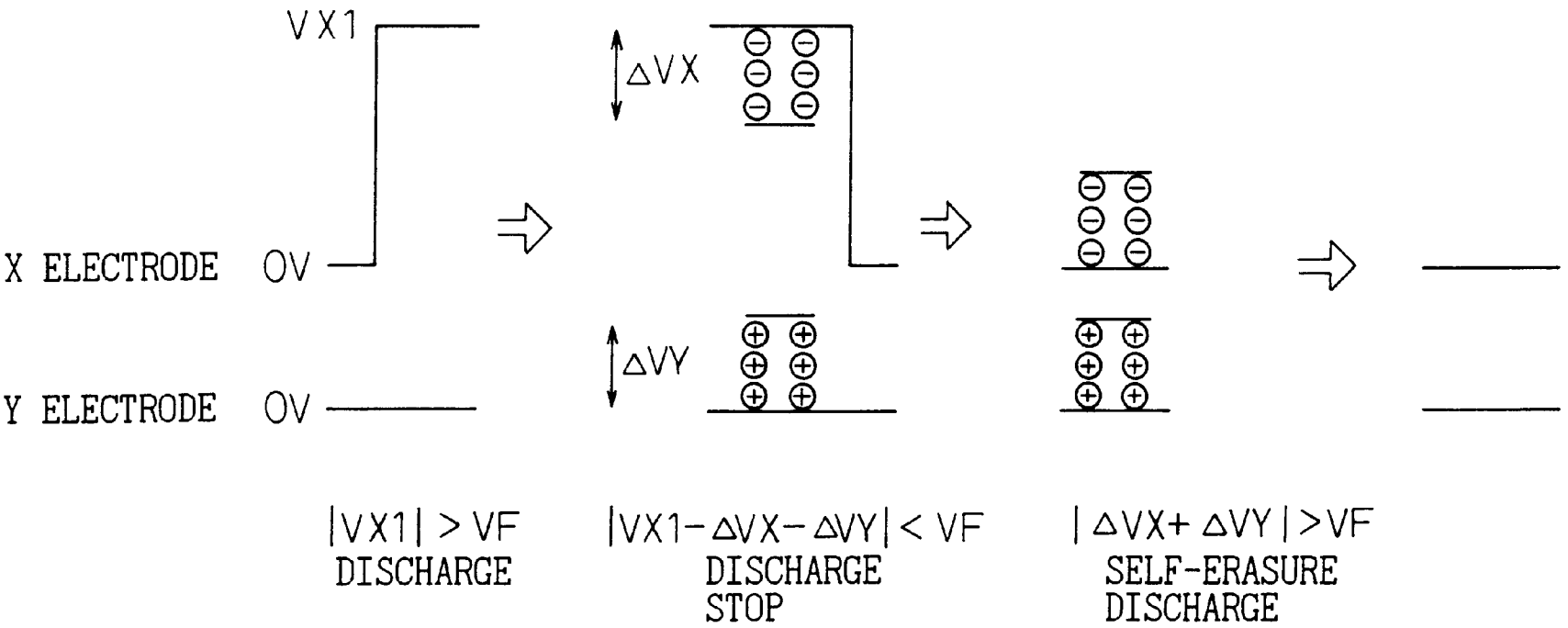
FIG. 6 is a diagram for explaining the principle of the self-erasure pulse.

In FIG. 6, assume that the voltage applied to the X electrodes is set to zero after the discharge begins by applying the voltage VX1 to the X electrodes as a result of charge accumulation before the discharge begins due to the charge accumulation. The amount of the charge accumulated is smaller than in the preceding case. Further, in the case where the voltage applied to the X electrodes is reduced to zero within a short time after the discharge begins, the positive and negative charge generated by the discharge are offset with each other and no wall charge occurs. In view of this, a method has been proposed in which the self-erasure discharge is caused by reducing the width of the reset pulse applied during the reset period.

As described above, according to the conventional method of driving the three-electrode AC-type PDP, a self-erasure discharge is caused by applying a reset pulse which is so high that all the cells discharge during the reset period. As a result, the light emission due to the application of a reset pulse or the light emission due to the self-erasure discharge reduces the contrast and hence the linearity of gradation display.

Now, a plasma display (PDP) apparatus according to an embodiment of the invention will be explained. The PDP apparatus of this embodiment has a similar configuration to the conventional one described with reference to FIGS. 1 to 5, except for the self-erasure pulse. Only the different parts will be explained below.

Figure 7:
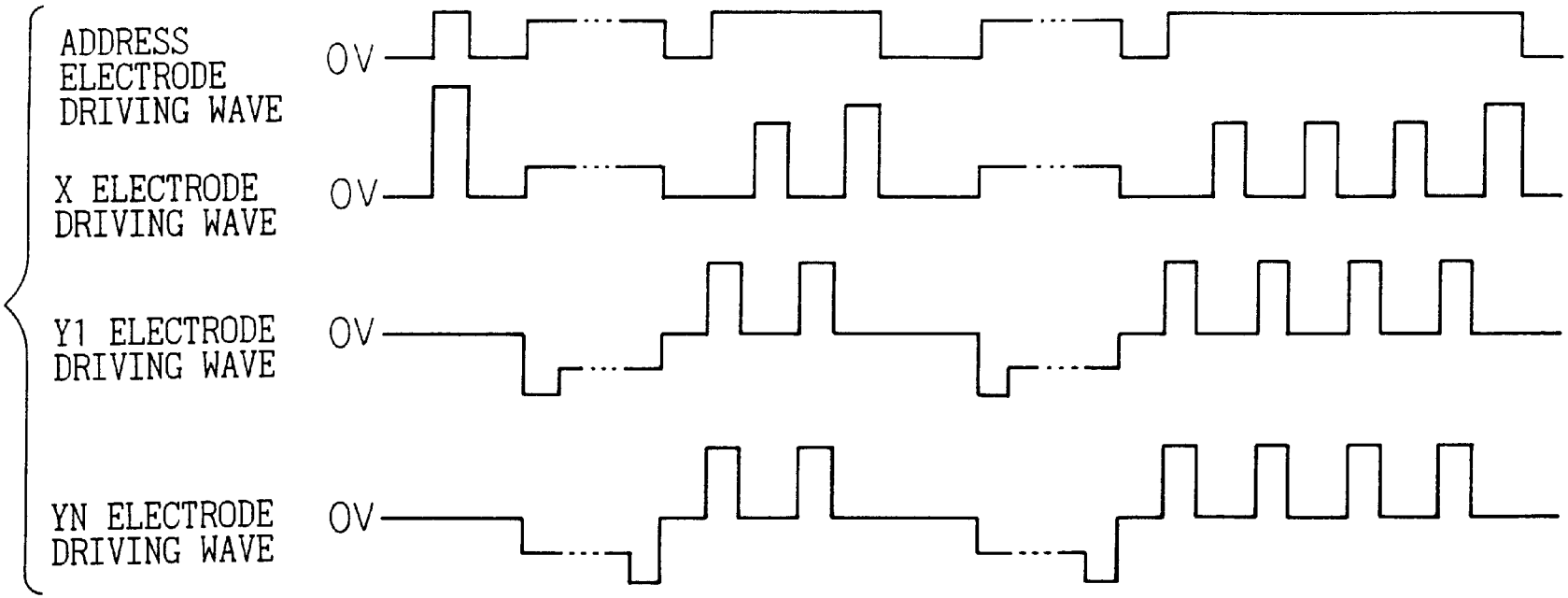
FIG. 7 is a diagram showing the drive waveforms of the PDP according to a first embodiment of the invention.

FIG. 7 is a diagram showing various drive waveforms for the PDP apparatus according to the first embodiment. As compared with FIG. 5, this embodiment is apparently different from the prior art in that the voltage of the last sustaining discharge pulse during the sustaining discharge period of each subfield is higher than other sustaining discharge pulses and the second and subsequent reset pulses are removed.

As shown in FIG. 7, in the first subfield after starting the PDP apparatus, as in the prior art, all the Y electrodes are reduced to 0 level during the reset period. At the same time, a full write pulse of a high voltage (about 330 V) is applied to the X electrodes, so that discharge occurs in all the cells on all the display lines. At this time, the potential of the addressing electrodes is about 100 V. The discharge is stopped by the accumulation of the wall charge. Since the applied voltage is high, the amount of wall charge accumulated is also large. Then, the potential between the X electrodes and the addressing electrodes becomes zero, and the voltage of the wall charge itself exceeds the discharge starting voltage in all the cells, thereby starting the self-erasure discharge. In this self-erasure discharge, all the cells in the panel come to assume a uniform state free of wall charge. During the next addressing period, the addressing discharge occurs in the cells turned on in accordance with the display data, and the wall charge is accumulated on the X and Y electrodes. During the next sustaining discharge period, the sustaining pulse is applied alternately to the Y and Y electrodes, and the sustaining discharge occurs in the cells where the addressing discharge has been effected during the addressing period, thereby displaying an image of one subfield. The configuration up to this juncture is identical to that of the prior art.

Figure 8:
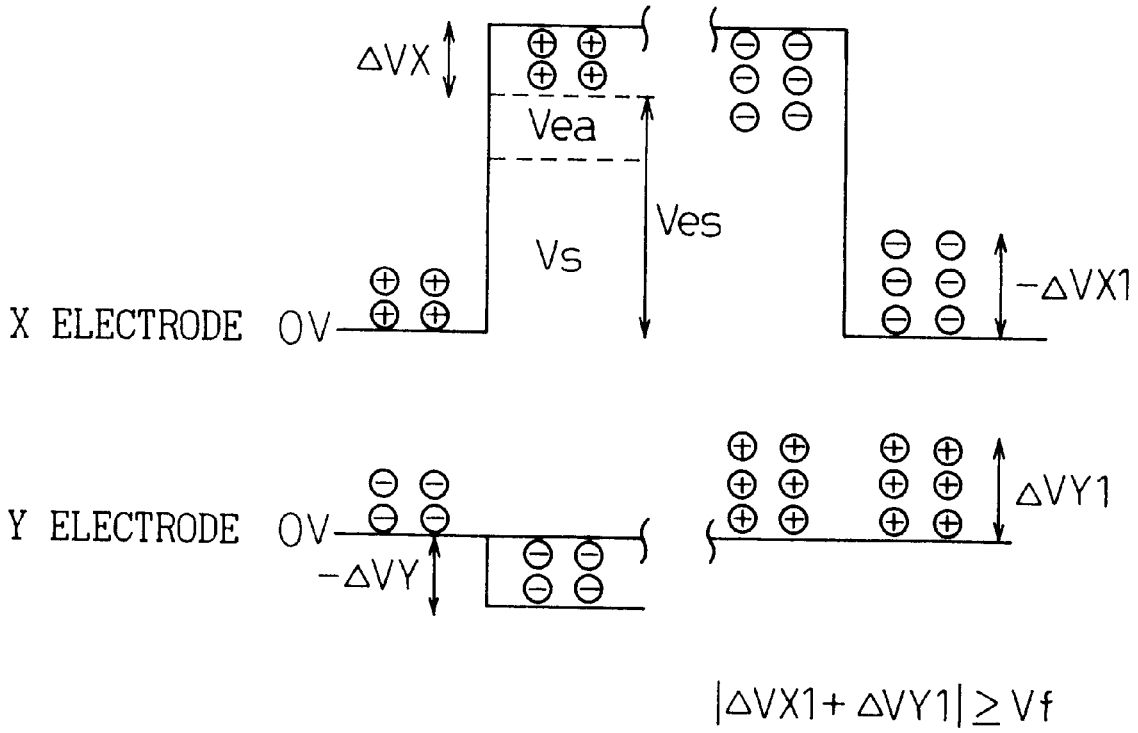
FIG. 8 is a diagram for explaining the self-erasure discharge according to the first embodiment.

As shown in FIG. 7, the voltage of the last sustaining discharge pulse is higher than the voltage of other sustaining discharge pulses during the sustaining discharge period of each subfield. The self-erasure discharge due to the last sustaining discharge pulse will be explained with reference to FIG. 8.

The discharge is caused by applying a sustaining discharge pulse of voltage Vs to the Y electrodes before the last sustaining discharge pulse. Then, the positive wall charge accumulates on the X electrodes, while the negative wall charge accumulates on the Y electrodes, and the discharge stops. Assume that a voltage ΔVX is generated due to the wall charge accumulated on the X electrodes, and a voltage −ΔVY is generated due to the negative wall charge accumulated on the Y electrodes. (normally, ΔVX=ΔVY) When the X and Y electrodes are both set to 0 V, therefore, the X and Y electrodes assume the potentials ΔVX and −ΔVY, respectively. As described above, the voltage ΔVX+ΔVY between the X and Y electrodes at this time is not higher than the discharge starting voltage, and therefore no discharge occurs. In the prior art, under these conditions, the sustaining discharge pulse of voltage Vs is applied to the X electrodes thereby to develop a sustaining discharge. Thus, the wall charges equivalent to the voltages ΔVX and ΔVY were stored again on the X and Y electrodes.

According to the first embodiment, in contrast, a pulse of voltage Ves (=Vs+Vea) is applied as a reset pulse to the X electrodes. This pulse is higher than the sustaining discharge pulse by Vea, and therefore the discharge naturally occurs. Thus, the negative wall charge is accumulated on the X electrodes, and the positive wall charge is accumulated on the Y electrodes, thus stopping the discharge. In the process, the wall charge is accumulated in a greater amount than during other sustaining discharge periods. Let −ΔVX1 be the voltage due to the negative wall charge accumulated on the X electrodes, and ΔVY1 be the voltage due to the positive wall charge accumulated on the Y electrodes. The voltage ΔVX1+ΔVY1 between the X and Y electrodes is higher than the discharge starting voltage. When both the X and Y electrodes are reduced to the potential of 0, therefore, the self-erasure discharge begins and the charge are neutralized. The voltage Ves is set to a level where no discharge occurs even if a reset pulse is applied to the cells formed with no wall charge for lack of the sustaining discharge. Thus, the discharge by the reset pulses occurs only in the cells which have been subjected to sustaining discharge to emit light. No wall discharge is accumulated on the electrodes of the cells not discharged upon application of a reset pulse thereto, and therefore such cells remain in the same state as if reset.

As described above, the discharge by the reset pulse and the resulting self-erasure discharge occur only in the cells intended for display. Therefore, the resulting light emission does not increase the background brightness and the contrast is not reduced. Further, in the case where the display brightness is set by considering the discharge due to the reset pulse and the self-erasure discharge associated therewith as discharges associated with the display, the linearity for gradation display can be maintained.

In the drive waveforms of FIG. 7, the last sustaining discharge pulse applied to the X electrodes is defined as a reset pulse. Nevertheless, the last sustaining discharge pulse, if applied to the Y electrodes, can also be used as a reset pulse.

Figure 9A:
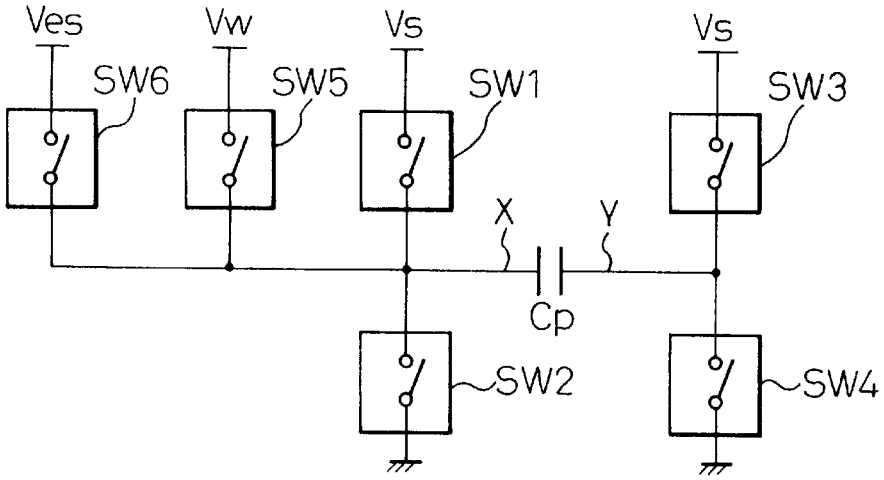
FIGS. 9A and 9B are diagrams showing a configuration and the operation of X/Y common drivers according to the first embodiment.
Figure 9B:
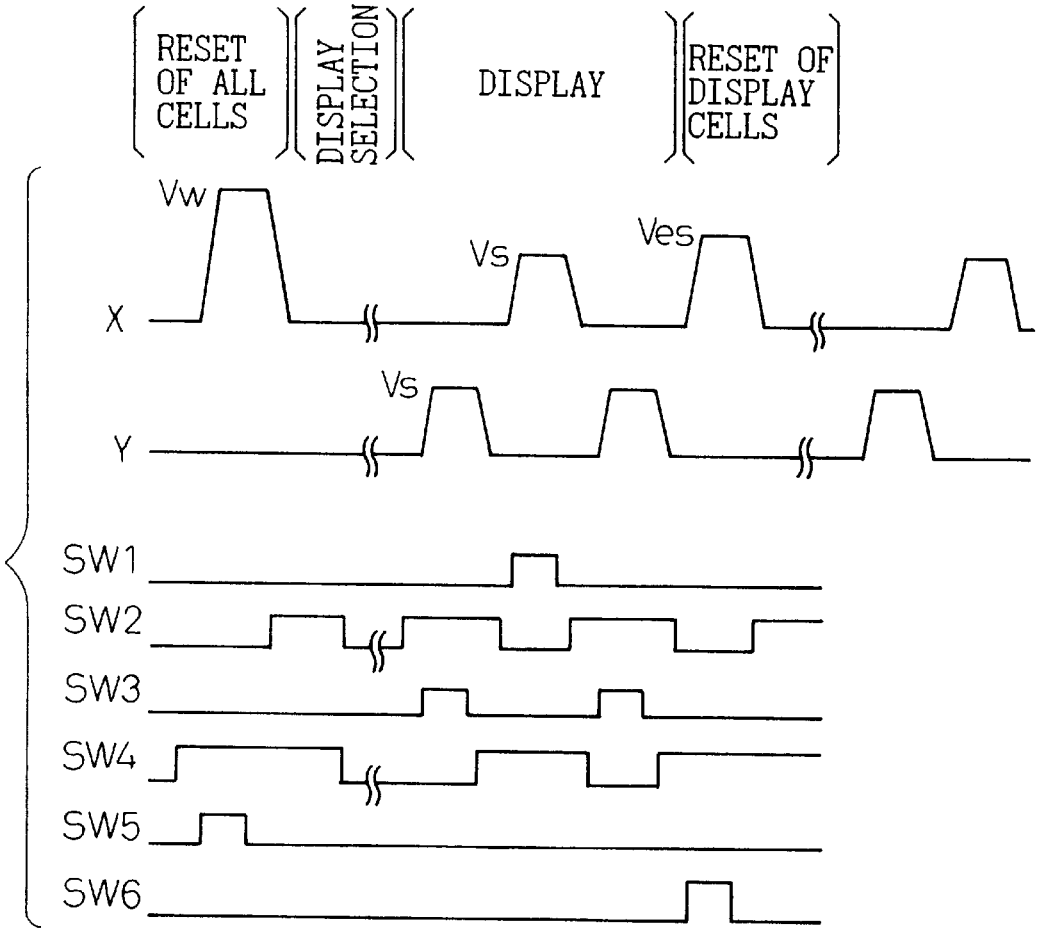

FIG. 9A shows a circuit configuration of a Y common drive 103 and an X common driver 104 for realizing the drive waveforms according to the first embodiment, and FIG. 9B shows the voltage waveforms applied to the X and Y electrodes and the operation of the switches.

As shown in FIG. 9A, this circuit includes a sustaining discharge voltage source for outputting a sustaining discharge voltage Vs, a first reset voltage source for outputting a voltage Vw of a first reset pulse, a second reset voltage source for outputting second and subsequent reset voltages Ves, and a grounding terminal. The X electrode is connected to the sustaining discharge voltage source through a switch SW1, to the grounding terminal through a switch SW2, to the first reset voltage source through a switch SW5, and to the second reset voltage source through a switch SW6. On the other hand, the Y electrode is connected to the sustaining discharge voltage source through a switch SW3 and to the grounding terminal through a switch SW4.

The X and Y electrodes are supplied with voltages as shown in FIG. 9B during the reset period and the sustaining discharge period from the Y command driver 103 and the X common driver 104, respectively. Each switch operates as shown in order to apply the above-mentioned voltages. Each switch is in the on state at a "high" H signal state and is in the off state at a "low" L signal state.

Figure 10A:
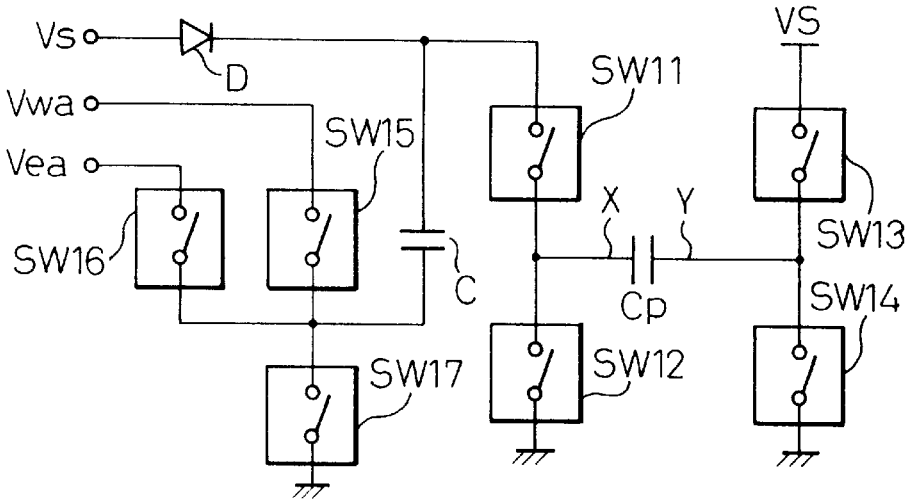
FIGS. 10A and 10B are diagrams showing another configuration and the operation of X/Y common drivers according to the first embodiment.
Figure 10B:
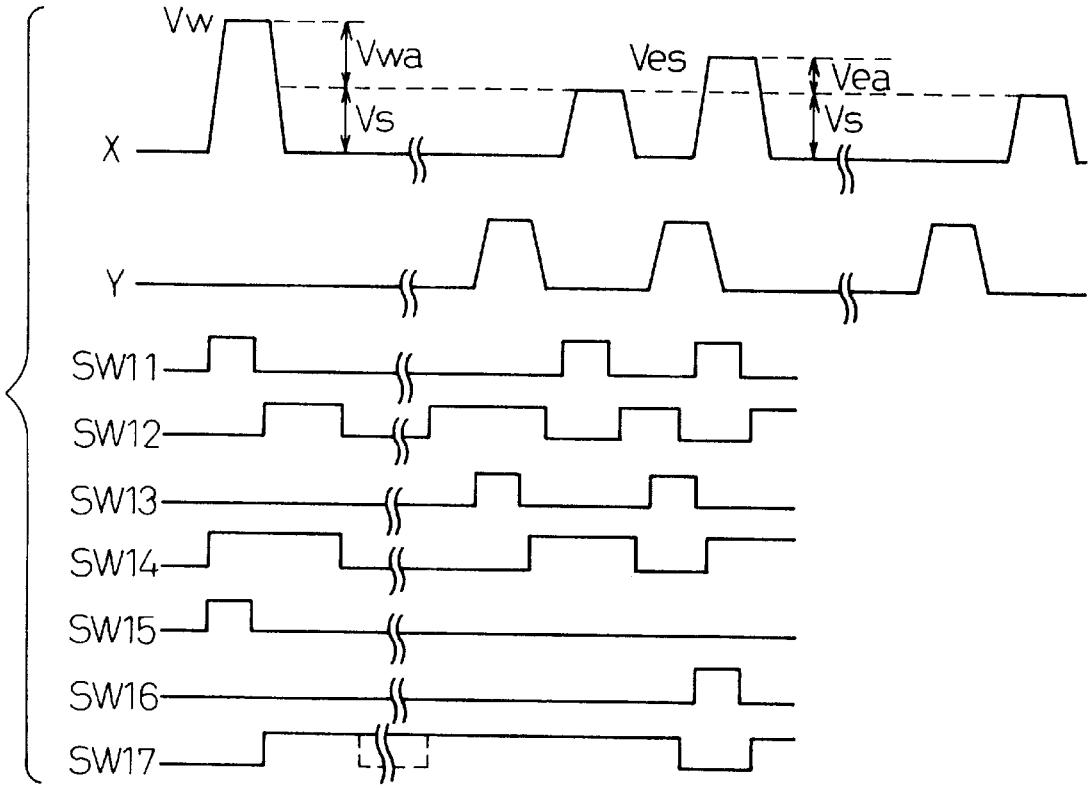

FIG. 10A shows another circuit configuration of the Y common driver 103 and the X common driver 104 for realizing the drive waveforms according to the first embodiment. FIG. 10B shows the voltage waveforms applied to the X and Y electrodes and the operation of each switch.

As shown in FIG. 10A, this circuit includes a sustaining discharge voltage source for outputting the sustaining discharge voltage Vs, a first reset difference voltage source for outputting a difference voltage Vwa between the first reset pulse voltage Vw and the sustaining discharge voltage Vs, a second reset difference voltage source for outputting a difference voltage Vea between the second and subsequent reset pulse voltage Ves and the sustaining discharge voltage Vs, and a grounding terminal. A diode D, a capacitor C and three switches SW15 to SW17 makes up a voltage superposition circuit for switching the output between the sustaining discharge voltage Vs to the switch SW11, the sustaining discharge voltage Vs superposed with the first difference voltage Vwa (i.e. the first reset pulse voltage Vw), and the sustaining discharge voltage Vs superposed with the second difference voltage Vea (i.e. the voltage Ves of the first reset pulse). The switches SW11 to SW14 have the same function as the switches SW1 to SW4 of FIG. 9A, respectively. The anode of the diode D is connected to a sustaining discharge voltage source, and the cathode is connected to one terminal of a terminal of the capacitor C and the switch SW11. The other end of the capacitor C is connected through the switch SW15 to the first reset difference voltage source, to a second reset difference voltage through the switch SW16, and to the grounding terminal through the switch SW17.

As shown in FIG. 10B, before the first reset pulse voltage Vw is applied to the X electrodes, the fifth switch SW15 and the sixth switch SW16 are turned off and the seventh switch SW17 is turned on. As a result, the capacitor C is charged to the sustaining voltage Vs across it. Next, the sixth switch SW16 and the seventh switch SW17 are turned off while the fifth switch 15 is turned on. Then, the other end of the capacitor C is supplied with the voltage Vwa, and therefore the voltage at an end of the capacitor C increases by the voltage Vs and assumes Vs+Vwa, i.e. the voltage Vw. Thus, the switch SW11 is turned on and the voltage Vw is applied to the X electrodes. Before the sustaining discharge voltage Vs is applied to the X electrodes, the fifth switch SW15 and the sixth switch SW16 are turned off while the seventh switch SW17 is turned on. The sustaining discharge voltage Vs is output from the switch SW11. Before the second or subsequent reset pulse voltage Ves is applied to the X electrodes, like when the voltage Vw is applied, the fifth switch SW15 and the sixth switch SW16 are turned off while the seventh switch SW17 is turned on. Next, the fifth switch SW15 and the seventh switch SW17 are turned off while the sixth switch SW16 is turned on. The other end of the capacitor C is supplied with the voltage Vea. The voltage Vs held is added to the voltage at an end of the capacitor C. Thus, the capacitor C assumes a voltage Vs+Vea, i.e. Ves. The switch SW11 thus is turned on and the voltage Vw is applied to the X electrodes.

According to the first embodiment, the voltage of the last sustaining discharge pulse is increased beyond the other sustaining discharge pulses to ensure the occurrence of the self-erasure discharge when the two electrodes are set at the same potential upon complete application of the last sustaining discharge pulse. To ensure the occurrence of the self-erasure discharge, the voltage of the last sustaining discharge pulse is desirably as high as possible. Once the voltage of the last sustaining discharge pulse exceeds the discharge starting voltage, however, even those cells that have not accumulated the wall charge and have not developed the sustaining discharge begin to discharge. Therefore, the voltage of the last sustaining discharge voltage cannot be increased beyond the discharge starting voltage. In the case where the self-erasure discharge cannot occur unless the voltage of the last sustaining discharge pulse is increased beyond the discharge starting voltage, therefore, the conditions for realizing the present invention are lacking. The second embodiment described below is an example in which the self-erasure discharge is positively caused even under such conditions.

Figure 11:
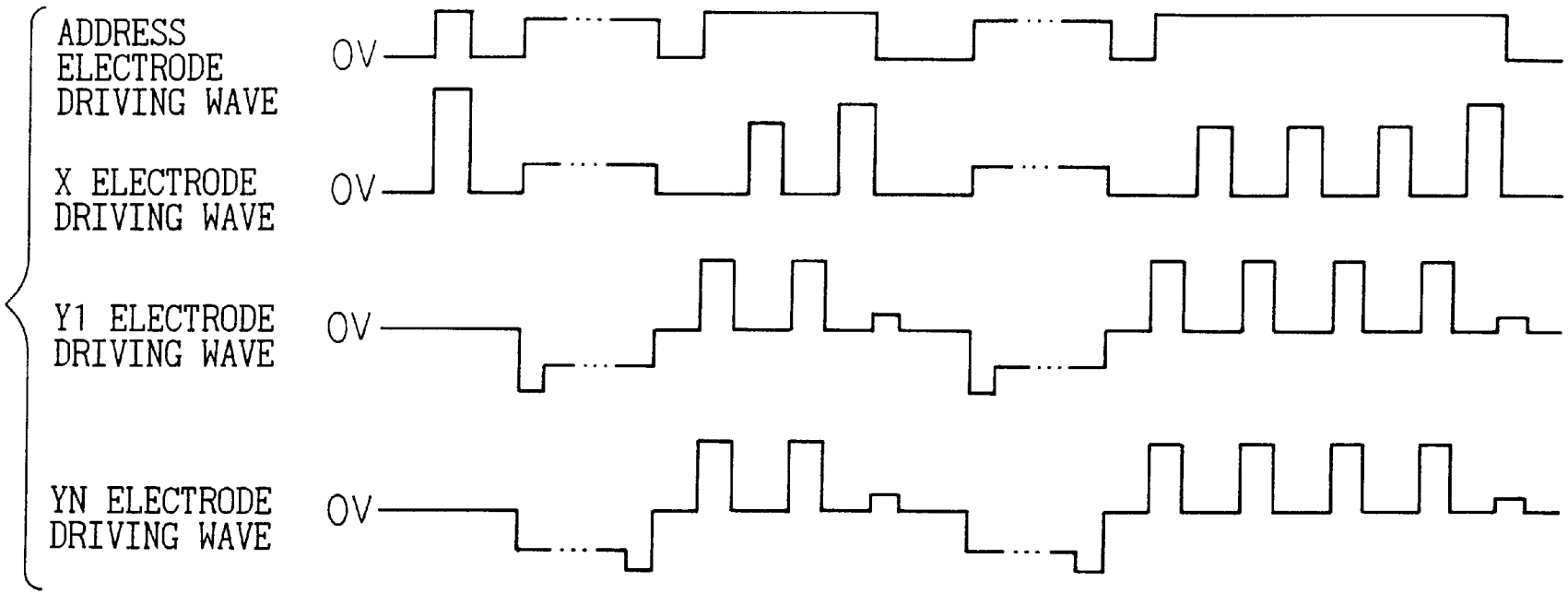
FIG. 11 is a diagram showing the drive waveforms for the PDP according to a second embodiment of the invention.

FIG. 11 is a diagram showing drive waveforms of the PDP apparatus according to the second embodiment of the invention. In the first embodiment of FIG. 7, both the X and Y electrodes are set to the potential of 0 V after the last sustaining discharge pulse is applied to the X electrodes. According to the second embodiment, on the other hand, the Y electrodes are supplied with a small positive voltage (several tens of volts), i.e. a pulse of a small voltage opposite in polarity to the last sustaining discharge pulse. Upon complete application of the last sustaining discharge pulse, the negative wall charge accumulates on the X electrodes and the positive wall charge accumulates on the Y electrodes. The pulse of the small voltage of opposite polarity, therefore, is superposed on the wall charge thereby to increase the voltages of the X and Y electrodes. As a result, even in the case where the self-erasure discharge cannot be started with the wall charge accumulated at the end of application of the last sustaining discharge pulse, the application of the small voltage of opposite polarity can start the self-erasure discharge. Even when the accumulated wall charge is sufficient to start the self-erasure discharge, positive occurrence of the self-erasure discharge is assured. The small pulse of opposite polarity thus added has so small a voltage that only a very small amount of the wall charge is accumulated after the discharge starts, and can be regarded substantially as a self-erasure discharge.

Figure 12:
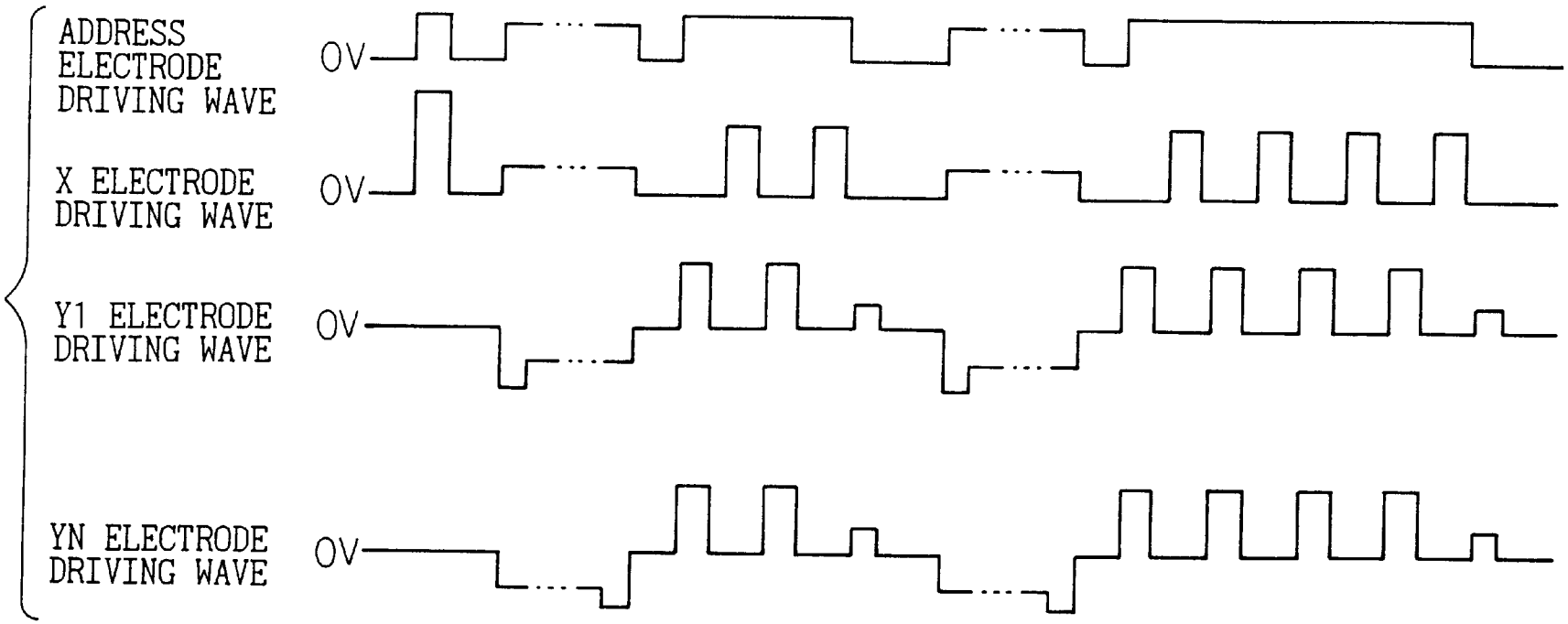
FIG. 12 is a diagram showing the drive waveforms for the PDP according to a third embodiment of the invention.

FIG. 12 is a diagram showing drive waveforms of the PDP apparatus according to a third embodiment of the invention. As shown, according to the third embodiment, all the sustaining discharge pulses, like in the prior art shown in FIG. 5, have the same voltage, and the self-erasure discharge is not activated even after complete application of the sustaining discharge pulse. After the last sustaining discharge pulse, a pulse of small voltage opposite in polarity to the last sustaining discharge pulse is applied. As described above, this small voltage of opposite polarity is superposed on the wall charge and increases the voltage between the X and Y electrodes. When this voltage increases beyond the discharge start voltage, therefore, the discharge begins. In such a case, too, the applied pulse of opposite polarity is so small that the amount of the wall charge accumulating after the discharge starts is very small and the charge can be regarded substantially as a self-erasure discharge.

Figure 13:
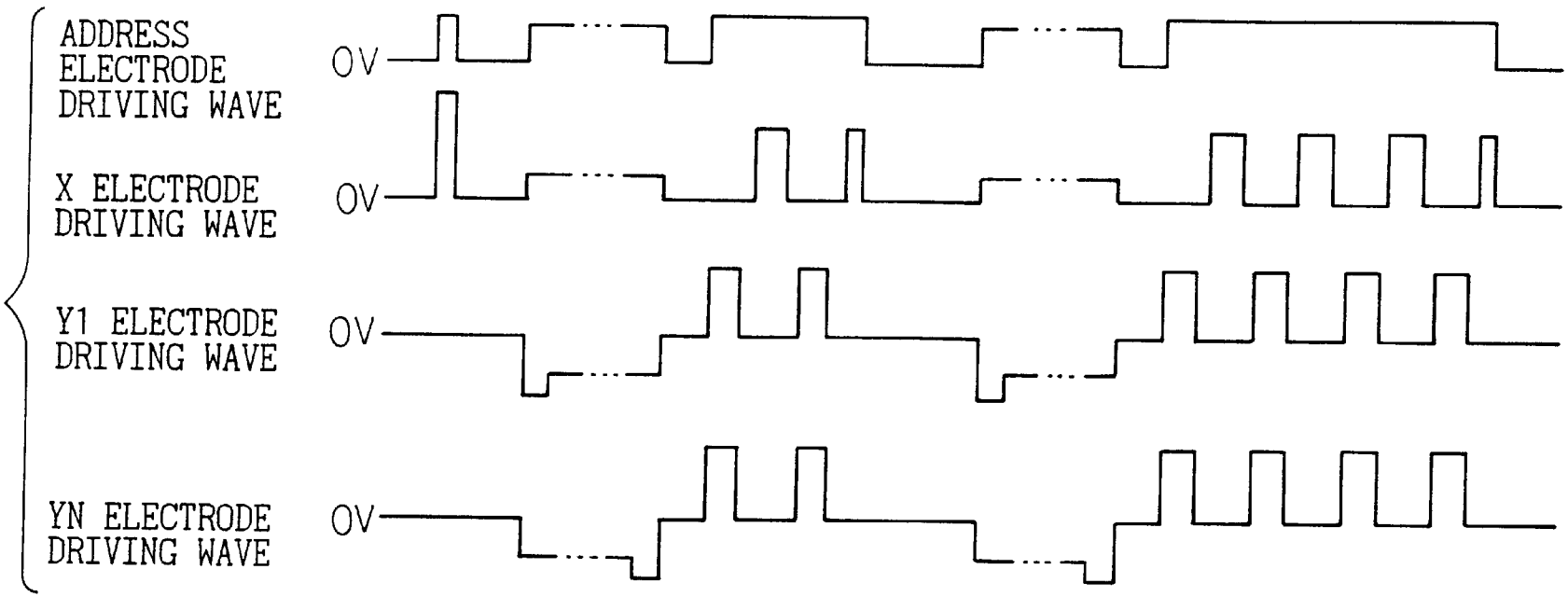
FIG. 13 is a diagram showing the drive waveforms for the PDP according to a fourth embodiment of the invention.

FIG. 13 is a diagram showing drive waveforms of the PDP apparatus according to a fourth embodiment of the invention. According to the fourth embodiment, like in the prior art of FIG. 5, all the sustaining discharge pulses assume the same voltage, although the last sustaining discharge pulse is shorter in width. Also, the first reset pulse, though as high as to cause the discharge of all the cells, is shorter in width. As described above, in the case where the pulse width is decreased and the pulse application is immediately stopped after occurrence of the discharge in accordance with the pulse application, the self-erasure discharge is realized by neutralization without accumulating the wall charge. Thus, the cells that emit light by sustaining discharge develop the self-erasure discharge upon application thereto of the last sustaining discharge voltage.

It will thus be understood from the foregoing description that, according to this invention, only the cells emitting light by sustaining discharge are caused to develop the self-erasure discharge and the reset operation is performed using the last sustaining discharge pulse. Since the cells not involved in the specific display are prevented from emitting light, the background brightness is not increased and a superior contrast is secured, while at the same time improving the linearity of the gradation display.

What is claimed is:

1. A method of driving a plasma display panel comprising a plurality of pairs of first and second electrodes arranged in parallel, and a plurality of third electrodes crossed with a plurality of said first and second electrodes, said first, second and third electrodes selectively defining a plurality of cells adapted for light emission by discharge, said method comprising the steps of:

performing self-erasure discharge by applying a reset voltage at least to a part of said first, second and third electrodes and thereby causing a plurality of said cells to discharge, and setting a plurality of said cells in a predetermined state by neutralizing the charge of each of said electrodes;

addressing each of said cells in said predetermined state by applying a voltage selectively to said cells in accordance with the display data and accumulating the charge corresponding to said display data for each cell; and applying a sustaining discharge voltage to a plurality of said cells and thereby causing the cells with predetermined charge accumulated therein to discharge and emit light;

wherein said reset voltage is set in such a manner that said self-erasure discharge occurs when said reset voltage is superposed on the charge accumulated on said electrodes of a plurality of said cells, and said self-erasure discharge is caused selectively in a part of said cells.

2. A method of driving a plasma display according to claim 1, wherein said reset voltage is set so that said self-erasure discharge occurs when said reset voltage is superposed on the voltage due to the charge accumulated on the electrodes of the cells discharged in said sustaining discharge step, and said self-erasure discharge occurs only in the cells discharged in said sustaining discharge step.

3. A method of driving a plasma display according to claim 2, wherein the application time of said reset voltage for the second and subsequent reset steps is shorter than the application time of said sustaining discharge voltage.

4. A method of driving a plasma display according to claim 2, wherein said reset voltage is smaller than said sustaining discharge voltage opposite in polarity to an immediately preceding sustaining discharge voltage.

5. A method of driving a plasma display according to claim 2, wherein said reset voltage for said first reset step after activation of said plasma display is set so that the self-erasure discharge occurs in all of a plurality of said cells, and wherein the reset voltage for the second and subsequent reset steps is lower than the voltage for said first reset step.

6. A method of driving a plasma display according to claim 5, wherein said reset voltage for the second and subsequent reset steps is higher than said sustaining discharge voltage.

7. A method of driving a plasma display according to claim 5, wherein the application time of said reset voltage for the second and subsequent reset steps is shorter than the application time of said sustaining discharge voltage.

8. A method of driving a plasma display according to claim 5, wherein a voltage sufficiently smaller than said reset voltage opposite in polarity to said first reset voltage is applied in said reset step after complete application of said first reset voltage.

9. A plasma display apparatus comprising:

a plasma display panel including a plurality of pairs of first and second electrodes arranged in parallel, and a plurality of third electrodes arranged at right angles to a plurality of pairs of said first and second electrodes, said first, second and third electrodes selectively defining a plurality of said cells adapted for light emission;

reset means for performing self-erasure discharge by applying a reset voltage at least to a part of said first, second and third electrodes and thereby causing a plurality of said cells to discharge, and setting a plurality of said cells in a predetermined state by neutralizing the charge of each of said electrodes;

addressing means for applying a voltage selectively to said cells in said predetermined state in accordance with the display data and accumulating the charge corresponding to said display data for each cell; and sustaining discharge means for applying a sustaining discharge voltage to a plurality of said cells and thereby causing the cells with predetermined charge accumulated therein to discharge and emit light;

wherein said reset means outputs said reset voltage set so that said self-erasure discharge occurs when said reset voltage is superposed on the charge accumulated on the electrodes of a plurality of said cells, and said self-erasure discharge is caused selectively in a part of said cells.

10. A plasma display apparatus according to claim 9, wherein said reset means applies said reset voltage adapted to cause said self-erasure discharge by superposing said reset voltage on the voltages due to the charge accumulated on the electrodes of the cells discharged in said sustaining discharge step, and said self-erasure discharge is effected only in the cells discharged in said sustaining discharge step.

11. A plasma display apparatus according to claim 10, wherein said reset means applies a reset voltage for a shorter time than said application time of said sustaining discharge voltage.

12. A plasma display apparatus according to claim 10, wherein said reset means applies a voltage sufficiently smaller than said first reset voltage and opposite in polarity to said first reset voltage after application of said first reset voltage.

13. A plasma,display apparatus according to claim 10, wherein said reset means applies a reset voltage smaller than said sustaining discharge voltage opposite in polarity to the immediately preceding sustaining discharge voltage.

14. A plasma display apparatus according to claim 10, wherein said reset means applies said reset voltage as a voltage higher than said sustaining discharge voltage.

15. A plasma display apparatus according to claim 14, wherein said reset means and said sustaining discharge means include a sustaining discharge voltage source for outputting said sustaining discharge voltage, a reset difference voltage source for outputting the difference voltage between said sustaining discharge voltage and said reset voltage, a voltage superposition circuit for switching between the output of said sustaining discharge voltage and the output of said sustaining discharge voltage with said difference voltage superposed thereon, a first switch interposed between said first electrode and said voltage superposition circuit, a second switch interposed between said first electrode and a grounding terminal, a third switch interposed between said second electrode and said sustaining discharge voltage source, and a fourth switch interposed between said second electrode and said grounding terminal, a predetermined voltage being applied to said first electrode and said second electrode by switching said first to fourth switches.

16. A plasma display apparatus according to claim 10, wherein said reset means applies a reset voltage causing said self-erasure discharge in all of a plurality of said cells as the first reset voltage after activation of said plasma display, and applies a reset voltage lower than said first reset voltage as the second and subsequent reset voltages.

17. A plasma display apparatus according to claim 16, wherein said reset means applies a reset voltage for a shorter time than the application time of said sustaining discharge voltage as said second and subsequent reset voltages.

18. A plasma display apparatus according to claim 16, wherein said reset means applies a reset voltage higher than said sustaining discharge voltage as said second and subsequent reset voltages.

19. A plasma display apparatus according to claim 18, wherein said reset means and said sustaining discharge means includes a first reset voltage source for outputting a first reset voltage, a second reset voltage source for outputting said second and subsequent reset voltages, a sustaining discharge voltage source for outputting said sustaining discharge voltage, a plurality of first switches interposed between said first electrode on the one hand and said first reset voltage source, said second reset voltage source, said sustaining discharge voltage source and said grounding terminal on the other hand, and a plurality of second switches interposed between said second electrode on the one hand and said sustaining discharge voltage source and said grounding terminal on the other hand, said first and second switches being switched thereby to apply a predetermined voltage to said first and second electrodes.

20. A plasma display apparatus according to claim 18, wherein said reset means and said sustaining discharge means includes a sustaining discharge voltage source for outputting said sustaining discharge voltage, a first reset difference voltage source for outputting a first difference voltage between said sustaining discharge voltage and said first reset voltage, a second reset voltage source for outputting a second difference voltage between said sustaining discharge voltage and said second and subsequent reset voltages, a voltage superposition circuit for switching between the output of said sustaining discharge voltage and the output of said sustaining discharge voltage with said first or second difference voltage superposed thereon, a first switch interposed between said first electrode and said voltage superposition circuit, a second switch interposed between said first electrode and said grounding terminal, a third switch interposed between said second electrode and said sustaining discharge voltage source, and a fourth switch interposed between said second electrode and said grounding terminal, a predetermined voltage being applied to said first electrode and said second electrode by switching said first to fourth switches.

21. A plasma display apparatus according to claim 20, wherein said voltage superposition circuit includes a diode with the anode thereof connected to the output of said sustaining discharge voltage source, a capacitor with an end thereof connected to the cathode of said diode, a fifth switch interposed between the other end of said capacitor and said first reset difference voltage source, a sixth switch interposed between the other end of said capacitor and said second reset difference voltage source, and a seventh switch interposed between the other end of said capacitor and said grounding terminal, and wherein when said sustaining discharge voltage is output, said fifth and sixth switches are turned off with said seventh switch turned on; when said sustaining discharge voltage is output with said first difference voltage superposed thereon, said fifth and sixth switches are turned off with said seventh switch turned on, after which said sixth and seventh switches are turned off with said fifth switch turned on; and when said sustaining discharge voltage is output with said second difference voltage superposed thereon, said fifth and sixth switches are turned off with said seventh switch turned on, after which said fifth and seventh switches are turned off with said sixth switch turned on.

* * * * *